US010920329B2

(12) United States Patent
Tremblay et al.

(10) Patent No.: US 10,920,329 B2
(45) Date of Patent: Feb. 16, 2021

(54) ANODE ASSEMBLY FOR ALUMINUM ELECTROLYSIS CELLS AND METHOD FOR MANUFACTURING ANODE ASSEMBLIES

(71) Applicant: UNIVERSITÉ DU QUÉBEC À CHICOUTIMI, Chicoutimi (CA)

(72) Inventors: Simon-Olivier Tremblay, Chicoutimi (CA); Daniel Marceau, Chicoutimi (CA)

(73) Assignee: UNIVERSITÉ DU QUÉBEC À CHICOUTIMI, Chicoutimi (CA)

( * ) Notice: Subject to any disclaimer, the term of this patent is extended or adjusted under 35 U.S.C. 154(b) by 456 days.

(21) Appl. No.: 15/556,934

(22) PCT Filed: Mar. 8, 2016

(86) PCT No.: PCT/CA2016/050249
§ 371 (c)(1),
(2) Date: Sep. 8, 2017

(87) PCT Pub. No.: WO2016/141475
PCT Pub. Date: Sep. 15, 2016

(65) Prior Publication Data

US 2018/0066372 A1 Mar. 8, 2018

Related U.S. Application Data

(60) Provisional application No. 62/129,859, filed on Mar. 8, 2015.

(51) Int. Cl.
*C25C 3/12* (2006.01)
*C25C 3/16* (2006.01)

(52) U.S. Cl.
CPC ..... *C25C 3/125* (2013.01); *C25C 3/16* (2013.01)

(58) Field of Classification Search
CPC ..... C25B 3/06–3/24; C25C 3/06–3/24
See application file for complete search history.

(56) References Cited

U.S. PATENT DOCUMENTS 4,574,019 A * 3/1986 Friedli ..... C25C 3/16 156/73.6
2004/0211663 A1* 10/2004 Gagne ..... C25C 3/06 204/280

(Continued)

FOREIGN PATENT DOCUMENTS

CA 2712981 A1 8/2009
CA 2919544 A1 2/2015

(Continued)

OTHER PUBLICATIONS

"International Application No. PCT/CA2016/050249, International Search Report dated May 18, 2016", (May 18, 2016), 3 pgs.

(Continued)

*Primary Examiner* — Ciel P Contreras
(74) *Attorney, Agent, or Firm* — Schwegman Lundberg & Woessner, P.A.

(57) ABSTRACT

An anode assembly for an aluminum electrolysis cell is provided. The anode assembly includes a baked anode block, a plurality of elongated connection elements each having an anode block contact surface and an electrical connection surface, at least one electromechanical crossbar connector covering the electrical connection surfaces of the elongated connection elements, and a crossbar electrically connected to the elongated connection elements. A method for manufacturing an anode assembly for an aluminum electrolysis cell is also provided. The method includes the steps of forming a block of green anode paste, inserting a plurality of elongated connection elements in the green anode paste, baking the green anode, positioning a crossbar above the electrical connection surfaces of the plurality of (Continued)

elongated connection elements, and covering the electrical connection surfaces and at least partially the crossbar with a surface-conforming electrically-conductive material.

20 Claims, 15 Drawing Sheets

(56) References Cited

U.S. PATENT DOCUMENTS

| | | | | |
|---|---|---|---|---|
| 2016/0208399 | A1* | 7/2016 | Berends | C25C 3/16 |
| 2016/0348258 | A1* | 12/2016 | Caratini | C25C 3/125 |

FOREIGN PATENT DOCUMENTS

| | | | |
|---|---|---|---|
| CA | 2914511 | A1 | 6/2015 |
| WO | WO-2012100340 | A1 | 8/2012 |

OTHER PUBLICATIONS

"International Application No. PCT/CA2016/050249, Written Opinion dated May 18, 2016", (May 18, 2016), 3 pgs.

* cited by examiner

ANODE ASSEMBLY FOR ALUMINUM ELECTROLYSIS CELLS AND METHOD FOR MANUFACTURING ANODE ASSEMBLIES

RELATED PATENT APPLICATION

This application is a U.S. National Stage Filing under 35 U.S.C. 371 from International Application No. PCT/CA2016/050249, filed on 8 Mar. 2016, and published as WO2016/141475 on 15 Sep. 2016, which claims the benefit under 35 U.S.C. § 119 of U.S. Provisional Application No. 62/129,859, filed on Mar. 8, 2015, which applications and publication are hereby incorporated by reference in their entireties.

TECHNICAL FIELD

The technical field relates to an anode assembly for an aluminum electrolysis cell. It also relates to a method for manufacturing an anode assembly for an aluminum electrolysis cell.

BACKGROUND

Aluminum production requires a considerable amount of electrical energy to supply the necessary electrons to the process. In typical Hall-Héroult processes, the electrical resistance of an electrolysis cell involves a potential loss of about 4.5 V, of which 1.8 V is theoretically necessary for the reduction reaction of $Al_2O_3$. The remaining 2.7 V is mainly associated with the resistance of the electrolyte, the electrodes (anode and cathode assemblies) and the conductors. Among these components, the anode assembly itself causes a loss of about 300 mV. It is believed that there is a promising potential to improve the electrical performance of the cells by optimising the anode assembly design.

In traditional anode assemblies for aluminum production, the anode assembly comprises a carbon anode block having stubholes formed therein. The stubholes are typically slightly conical holes. A steel stub is inserted in each one of the stubholes. The steel stubs are joined together by a steel crossbar positioned above each one of the stubs. The crossbar is then connected to an aluminum rod using a clad. To fix a stub to the carbon anode block, molten iron is cast in the stubholes, thus forming a thimble around the steel stub. Thus, a traditional anode assembly comprises the carbon anode block, steel stubs inserted in the carbon anode block, the cast iron thimble surrounding each one of the steel stubs, the steel crossbar connecting the steel stubs together, the aluminum rod and the clad connecting the aluminum rod to the steel crossbar. This assembly provides mechanical support for the anode and conducts heat and electric current from an electric current source to the carbon anode block.

However, in this traditional design, a gap usually forms at the cast iron to carbon interface after the cast iron has solidified. Depending on the cast iron thickness, chemical composition of the cast iron as well as the casting conditions, the shrinkage of the cast iron is greater in the upper portion of the interface than the lower one. In operation, the contact is then initiated at the lower part of the interface since the residual gap is smaller and the temperature is higher. Consequently, the non-uniformity of the gap at the interface coupled with the variable radial expansion of the metallic components (stub and thimble) result in a partial contact (portion of the total contact area) at the cast iron to carbon interface.

Since the conduction of the electrical current is promoted by the contact pressure between the stub and the carbon anode block via the cast iron thimble, partial contact between those components can lead to an undesired voltage drop and, consequently, to a high electric energy consumption during operation of the anode assembly.

In view of the above, there is a need for another anode assembly which would be able to overcome or at least minimize some of the above-discussed concerns.

BRIEF SUMMARY

It is therefore an aim of the present invention to address the above mentioned issues.

According to a first aspect, there is provided an anode assembly for an aluminum electrolysis cell. The anode assembly comprises: a baked anode block; a plurality of elongated connection elements, each having an anode block contact surface and an electrical connection surface, the anode block contact surface being embedded in the baked anode block and being in electrical communication with the baked anode block; at least one electromechanical crossbar connector covering the electrical connection surfaces of the elongated connection elements; a crossbar having a lower section embedded in the at least one electromechanical crossbar connector and being in electrical communication therewith, the crossbar being electrically connected to the plurality of elongated connection elements through their electrical connection surfaces and the at least one electromechanical crossbar connector.

In an embodiment, the baked anode block comprises at least one connector molding cavity, the at least one electromechanical crossbar connector extending in and at least partially filling the at least one connector molding cavity.

In an embodiment, the at least one connector molding cavity has a depth ranging between about 2% to about 25% of a height of the baked anode block.

In an embodiment, the at least one electromechanical crossbar connector is at least one cast iron based crossbar connector.

In an embodiment, the elongated connection elements extend substantially parallel to one another and in a spaced-apart arrangement.

In an embodiment, the elongated connection elements have a substantially rectangular prism shape.

In an embodiment, a ratio of a width and a length of the elongated connection elements ranges between about 0.1 and about 5.

In an embodiment, a ratio of a height and a length of the elongated connection elements ranges between about 2 and about 20.

In an embodiment, the anode block contact surface of the elongated connection elements is in direct contact with the baked anode block.

In an embodiment, the baked anode block further comprises a plurality of elongated slots, and wherein each one of the elongated connection elements is inserted into a respective one of the elongated slots.

In an embodiment, the elongated slots have a length exceeding a longitudinal face length of the elongated connection elements inserted therein, at least at one end thereof, forming a gap.

In an embodiment, the elongated connection elements are made of steel.

In an embodiment, each one of the elongated connection elements has a thickness ranging from about 2 to about 50 mm.

In an embodiment, each one of the elongated connection elements has a thickness ranging from about 6 to about 19 mm.

In an embodiment, a length of the elongated connection elements is comprised between about 50% and about 80% of a length of the baked anode block.

In an embodiment, the elongated connection elements are positioned at a height comprised between about 5% and about 40% of a height of the baked anode block, below an uppermost surface thereof.

In an embodiment, the elongated connection elements are positioned at a height comprised between about 15% and about 30% of a height of the baked anode block, below an uppermost surface thereof.

In an embodiment, the elongated connection elements extend substantially parallel to longitudinal faces of the baked anode block.

In an embodiment, at least one of the elongated connection elements has at least one surface coated with a graphite-based material.

In an embodiment, the baked anode block comprises a plurality of anode block sections separated by a gap.

In an embodiment, there is provided an aluminum electrolysis cell comprising the anode assembly as described herein.

According to a second aspect, there is provided a method for manufacturing an anode assembly for an aluminum electrolysis cell. The method comprises: forming a block of green anode paste; inserting a plurality of elongated connection elements having an anode block contact surface and an electrical connection surface in the block of green anode paste, the anode block contact surface being surrounded by the green anode paste; baking the block of green anode paste comprising the elongated connection elements to obtain a baked anode block; positioning a crossbar above the electrical connection surfaces of the plurality of elongated connection elements inserted in the baked anode block; and covering the electrical connection surfaces and at least partially the crossbar with a surface-conforming electrically-conductive material to form at least one electromechanical crossbar connector therebetween providing electrical communication between the electrical connection surfaces of the plurality of elongated connection elements and the crossbar.

In an embodiment, the method further comprises forming at least one connector molding cavity in the block of green anode paste.

In an embodiment, the method further comprises forming a plurality of elongated slots in the block of green anode paste.

In an embodiment, the method further comprises simultaneously forming at least one connector molding cavity and a plurality of elongated slots in the block of green anode paste.

In an embodiment, the forming of the at least one connector molding cavity in the block of green anode paste comprises simultaneously inserting the plurality of elongated connection elements therein, the electrical connection surface of the elongated connection elements being exposed in the least one connector molding cavity following insertion.

In an embodiment, the covering of the electrical connection surfaces with the surface-conforming electrically-conductive material further comprises the step of at least partially filling the connector molding cavity with the surface-conforming electrically-conductive material.

In an embodiment, the covering of the electrical connection surfaces of the elongated connection elements comprises pouring molten cast iron into the connector molding cavity to cover the electrical connection surfaces and at least a lower surface of the crossbar.

In an embodiment, the electrical connection surfaces of the elongated connection elements are exposed prior to baking.

In an embodiment, the inserting the elongated connection elements in the block of green anode paste comprises compacting the block of green anode paste and simultaneously inserting the elongated connection elements therein.

In an embodiment, the method further comprises heating the elongated connection elements prior to inserting the elongated connection elements in the block of green anode paste.

Other features and advantages will be better understood upon reading of embodiments thereof with reference to the appended drawings.

BRIEF DESCRIPTION OF THE DRAWINGS

It will be noted that throughout the appended drawings, like features are identified by like reference numerals.

DETAILED DESCRIPTION

Figure 1:
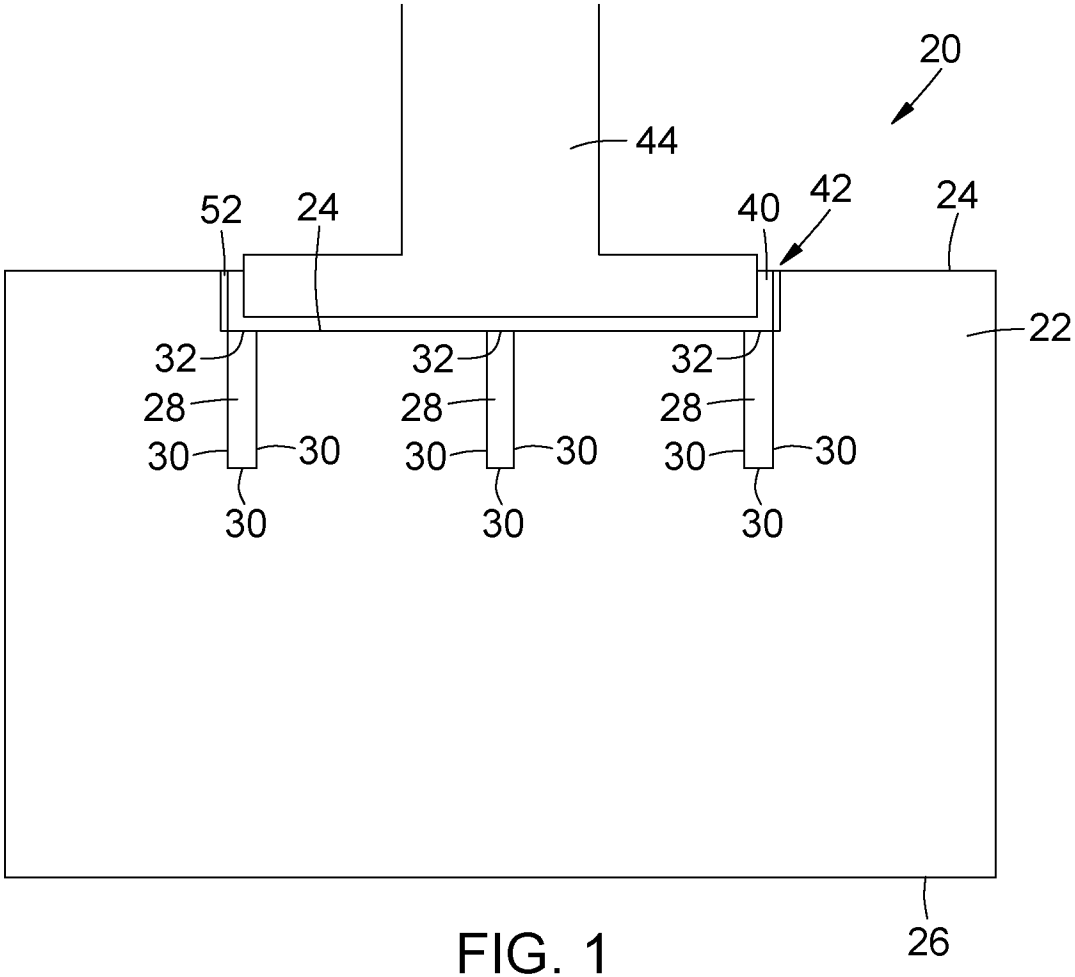
FIG. 1 is a schematic side cross-section view of an anode assembly for aluminum electrolysis cells in accordance with an embodiment.

Although the embodiments of the anode assembly and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the anode assembly, as will be briefly explained herein and as can be easily inferred herefrom by a person skilled in the art. Moreover, it will be appreciated that positional descriptions such as "above", "below", "top", "bottom", "left", "right", "vertical" and the like should, unless otherwise indicated, be taken in the context of the figures and should not be considered limiting.

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

According to a first aspect, there is provided an anode assembly for aluminum electrolysis cells. Referring to FIGS. 1, 2, 5 and 6, in an embodiment, there is provided an anode assembly 20 including a baked anode block 22 having a top surface 24, opposed to a base 26. The baked anode block 22 is typically formed with a green anode paste that is baked to obtain a baked anode block 22 having given dimensions and specific properties. The baked anode block 22 is typically made of carbon, i.e. a calcined carbon body. In the embodiment shown, the top surface 24 of the baked anode block 22 has a connector molding cavity 42 (FIG. 6) defined about centrally therein. In this description, the top surface of the baked anode block 22, in the connector molding cavity 42, is referred to as being part of the top surface 24 of the baked anode block 22. It will be readily understood by the person skilled in the art that the shape and size of the connector molding cavity can vary.

Figure 2:
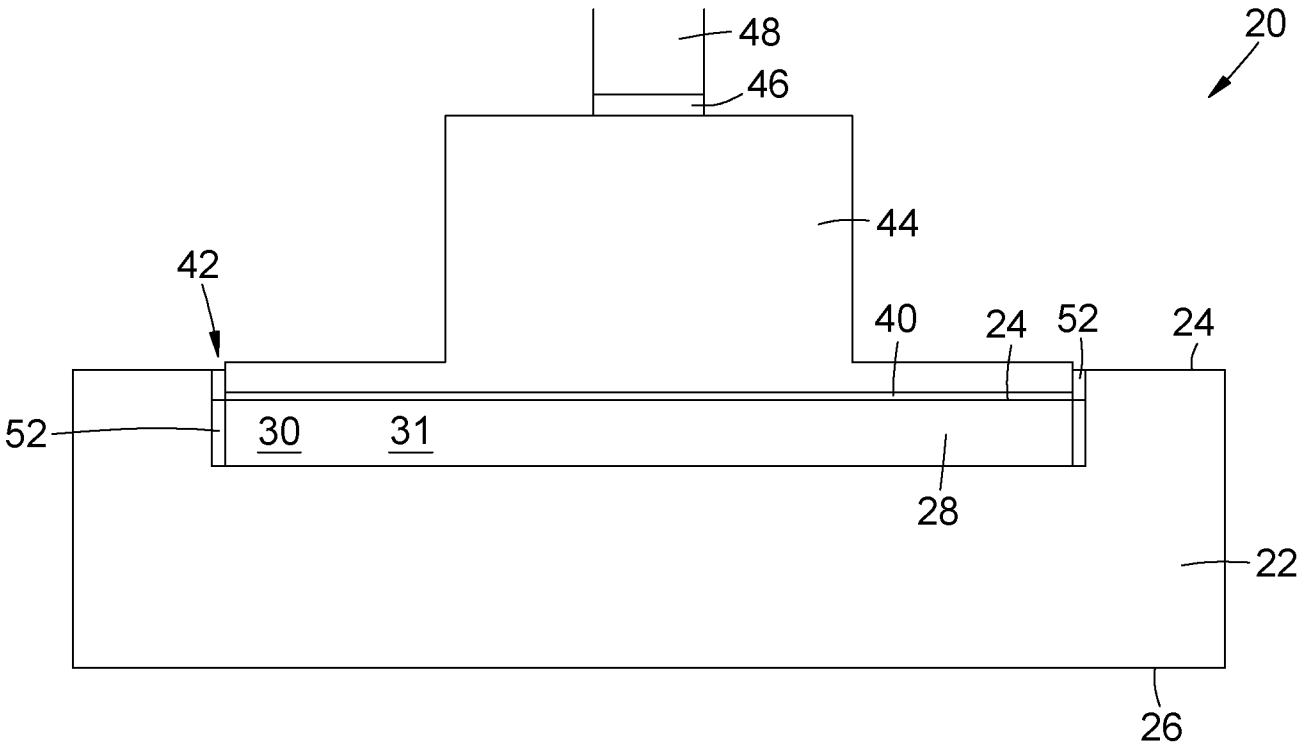
FIG. 2 is a schematic front cross-section view of the anode assembly shown in FIG. 1.

Still referring to FIGS. 1 and 2, in an embodiment, the anode assembly 20 further includes a plurality of elongated connection elements 28 embedded in the anode assembly 20. In an embodiment, each one of the elongated connection elements 28 is a substantially rectangular prism made of an electrically conductive material, such as steel. In the embodiment shown, the elongated connection elements 28 are made of 1018 steel.

Each one of the elongated connection elements 28 includes an anode block contact surface 30 and an electrical connection surface 32. The elongated connection elements 28 are contained in the baked anode block 22. More particularly, the anode block contact surface 30 of each one of the elongated connection elements 28 is embedded in the baked anode block 22 so that the anode block contact surface 30 is surrounded by calcined carbon, i.e. the material of the baked anode block 22. The anode block contact surface 30 contacts, directly or indirectly, with the baked anode block 22. Prior to insertion of an electromechanical crossbar connector 40 and, typically following baking, the electrical connection surface 32 of the elongated connection element 28 is exposed at the top surface 24 of the baked anode block 22.

In the description, the term "exposed", with reference to the elongated connection element 28, refers to a section of the elongated connection element 28 and, more particularly, the electrical connection surface 32, being not conterminous with calcined carbon, i.e. the material of the baked anode block 22. As will be described in more details below, the electrical connection surface 32 is not exposed in the resulting anode assembly 20 but is exposed prior to insertion of the electromechanical crossbar connector 40, and is in contact therewith thereafter.

In the embodiment shown in FIGS. 1 and 2, the anode assembly 20 includes three spaced-apart elongated connection elements 28 embedded in the baked anode block 22, except for the electrical connection surface 32 including a top face thereof. It is appreciated that the number, shape, and configuration of the elongated connection elements 28 can vary from the embodiment shown. The anode block contact surface 30 has a section defined on each face of the elongated connection element 28 contained in the baked anode block 22. The anode block contact surface 30 is in electrical communication with the baked anode block 22. In the embodiment shown, the anode block contact surface 30 includes sections on both longitudinal faces 31, on a bottom face 36 and on each lateral end face 38 of each elongated connection element 28. The two lateral end faces 38 and the bottom face 36 of the elongated connection elements 28 can be seen in FIG. 3. In the embodiment shown, the surface area of the lateral end faces 38 is significantly smaller than the surface area of the vertically-extending longitudinal faces 31 of the elongated connection element 28. Thus, the lateral end faces 38 contribute to a smaller proportion of the electrical current that can be conducted from each of the elongated connection elements 28 to the baked anode block 22 compared to the longitudinal faces 31 of the elongated connection elements 28.

In the embodiment shown, the electrical connection surface 32 of each elongated connection element 28 is defined at least by a top face thereof. As mentioned above, the electrical connection surface 32 is exposed at the top surface 24 of the baked anode block 22, prior to insertion of the electromechanical crossbar connector 40, and is in contact therewith thereafter, as will be described in more details below. In the embodiment shown in FIGS. 1 and 2, the connection surfaces 32 are aligned and coplanar with the top surface 24 of the baked anode block 22, inside the connector molding cavity 42.

In another embodiment (not illustrated), an elongated connection element 28 can be contained in the baked anode block 22 in such a fashion that its top face extends above the top surface 24 of the baked anode block 22, for instance, inside the connector molding cavity 42. In such embodiment, the electrical connection surface 32 includes the top face of the elongated connection element 28 but also sections of its longitudinal and lateral end faces 31, 38 extending outwardly of the baked anode block 22, adjacent to the anode block contact surfaces 30 defined on the same longitudinal and lateral end faces 31, 38. In other words, one face of the elongated connection element 28, located between the bottom surface 36 and a top face thereof, can include a section of the anode block contact surface 30 and a section of the electrical connection surface 32. Moreover, in another embodiment (not illustrated), an anode block contact surface 30 of an elongated connection element 28 can be embedded in the baked anode block 22 in such a fashion that its top face is exposed, following baking, but extend below the top surface 24 of the anode block 22.

In the embodiment shown, the elongated connection elements 28 extend below the top surface 24 in the connector molding cavity 42 and their top face, i.e. the electrical connection surface 32, is exposed in the connector molding cavity 42. Thus, the electrical connection surfaces 32 of the elongated connection elements 28 are in a same plane as the top surface 24 of the anode block 22 in the connector molding cavity 42. The top face of the elongated connection elements 28 is recessed with respect to a peripheral section of the top surface 24 of the anode block 22, i.e. the uppermost top surface.

In an embodiment, as will be described in more details below, the elongated connection elements 28 are inserted in the green anode paste prior to baking thereof and kept in the green anode paste during the baking process.

Referring back to the embodiment shown in FIGS. 1 and 2, the anode assembly 20 further includes a crossbar 44 electrically connecting together the plurality of elongated connection elements 28 through their electrical connection surfaces 32. In an embodiment, the crossbar 44 is made of steel. In another embodiment, the crossbar 44 is made of the same steel as a core of the elongated connection elements 28. In another embodiment, the crossbar 44 and a core of the elongated connection elements 28 are made of the same electrically conductive material.

Still referring to FIGS. 1 and 2 and in accordance with an embodiment, the anode assembly 20 also includes an electromechanical crossbar connector 40 covering the electrical connection surfaces 32 of the elongated connection elements 28 and receiving therein at least a portion of the crossbar 44 to define an electrical path between the crossbar 44 and the baked anode block 22 via the elongated connection elements 28. In an embodiment, the electrically conductive material of the electromechanical crossbar connector 40 is selected by taking into account the material of the elongated connection elements 28 and the crossbar 44. In an embodiment, the electrically conductive material may be selected according to its castability properties and its wettability with regard to the material of the elongated connection elements 28 and, in an embodiment, steel. In some implementations, the electromechanical crossbar connector 40 is made of a cast iron based material.

In an embodiment, the electromechanical crossbar connector 40 can be formed in the connector molding cavity 42. In an embodiment, the combination of the electromechanical crossbar connector 40 and the crossbar 44 at least partially fills the connector molding cavity 42. The electromechanical crossbar connector 40 can be made by casting the electrically conductive material of the electromechanical crossbar connector 40 in the connector molding cavity 42 of the baked anode block 22, following insertion of the elongated connection elements 28 and positioning of the crossbar 44 above the elongated connection elements 28.

In an embodiment, the electromechanical crossbar connector 40 can be made of cast iron and formed between the electrical connection surfaces 32 of the elongated connection elements 28 and the crossbar 44. The cast iron electromechanical crossbar connector 40 covers the electrical connection surfaces 32 of the elongated connection elements 28. A section of the electromechanical crossbar connector 40 extends between the electrical connection surfaces 32 of the elongated connection elements 28 and a lower face of the crossbar 44, the lower face of the crossbar 44 being spaced-apart from the top surface 24 of the anode block 22, for instance in the connector molding cavity 42. In an embodiment, the distance between the lower face of the crossbar 44 and the top surface 24 of the anode block 22 and/or the top face of the elongated connection elements 28 can be up to 15% of a height of the baked anode block 22.

In an embodiment wherein the electrical connection surfaces 32 are located above the top surface 24 of the baked anode block 22, the electrical connection surfaces 32 may be in direct contact with the lower face of the crossbar 44 while the lower face of the crossbar 44 is spaced-apart from the top surface 24 of the anode block 22.

Figure 3:
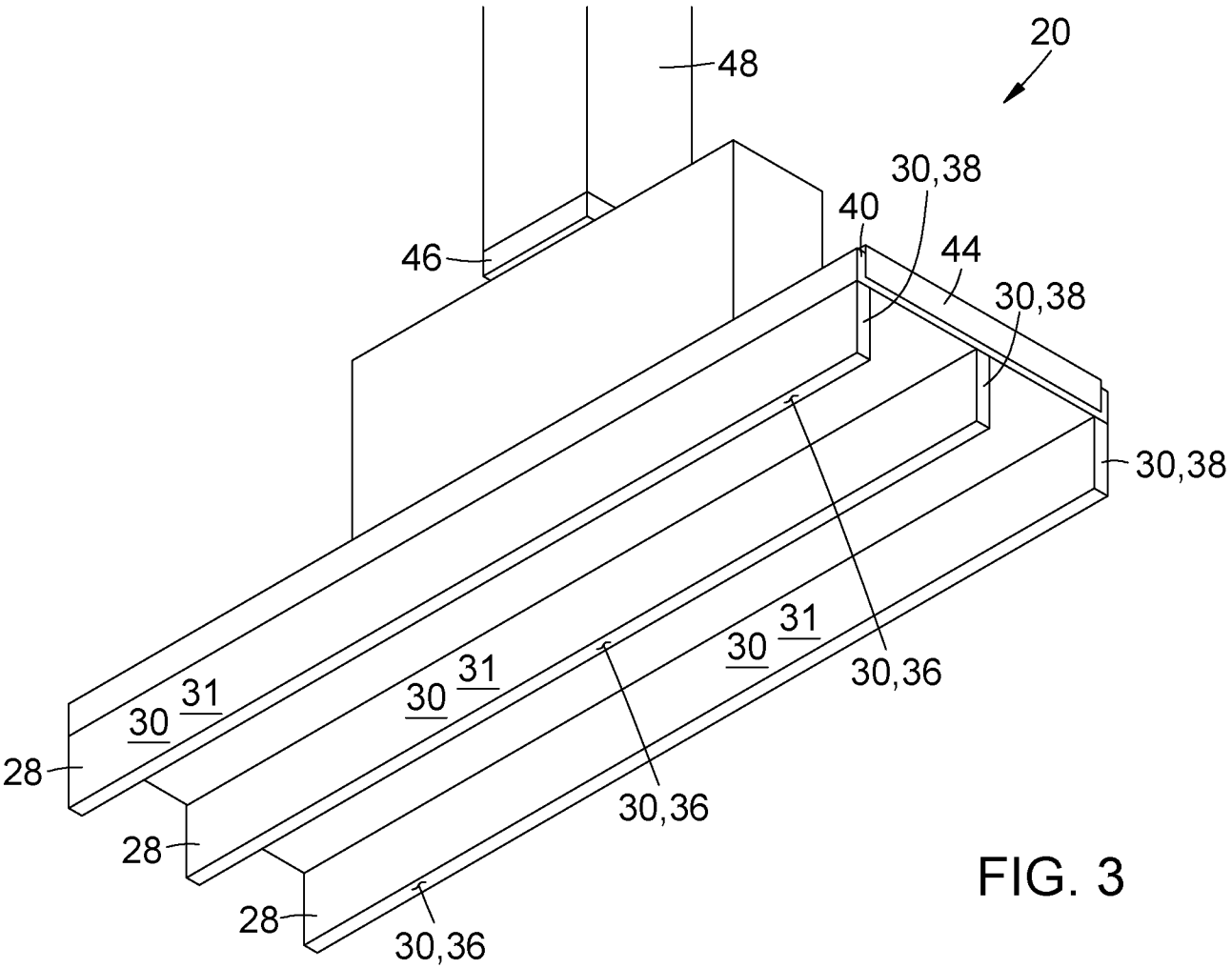
FIG. 3 is a schematic bottom perspective view of the anode assembly shown in FIG. 1, with the anode block omitted.
Figure 4:
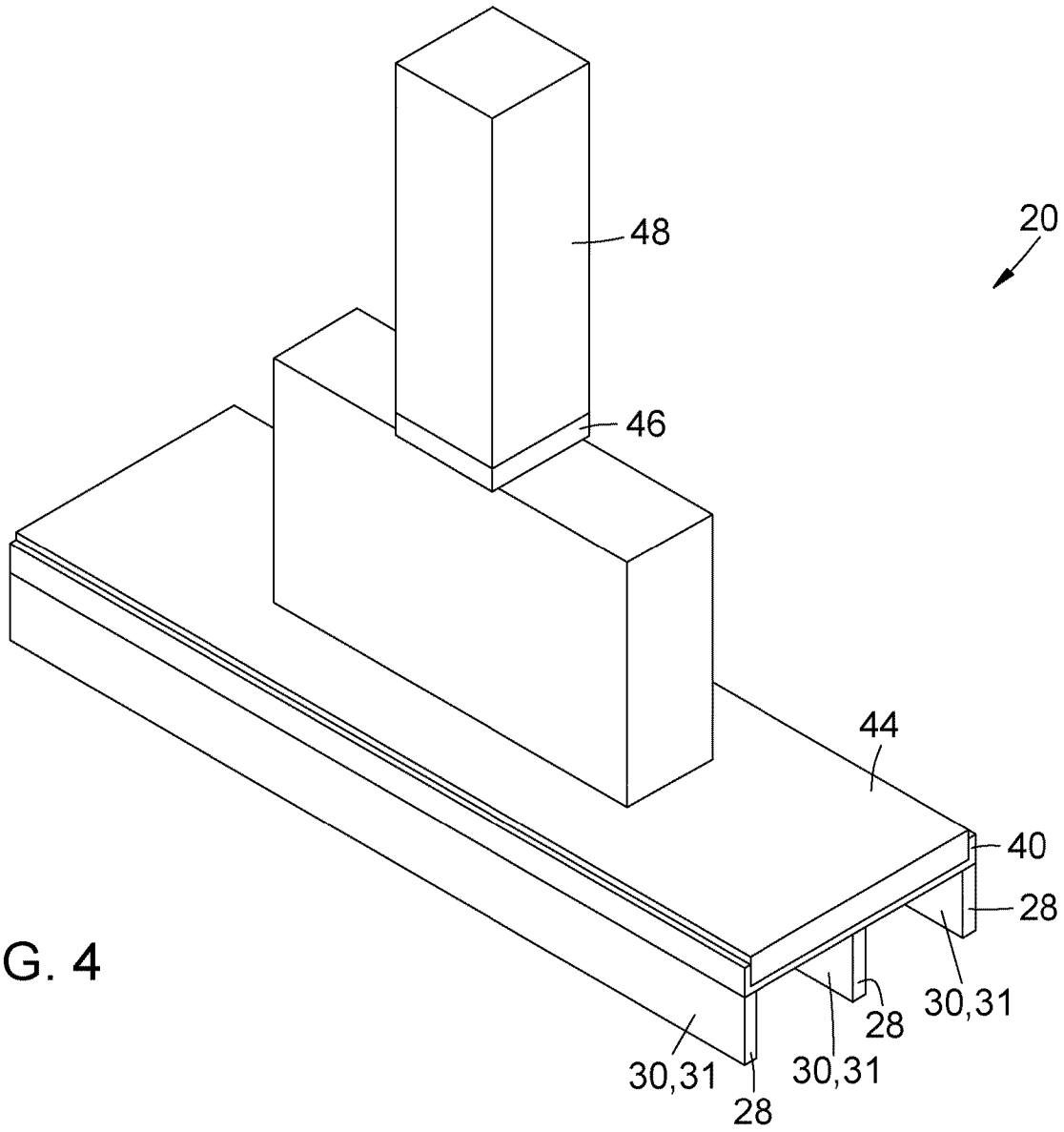
FIG. 4 is a schematic top perspective view of the anode assembly shown in FIG. 3.
Figure 5:
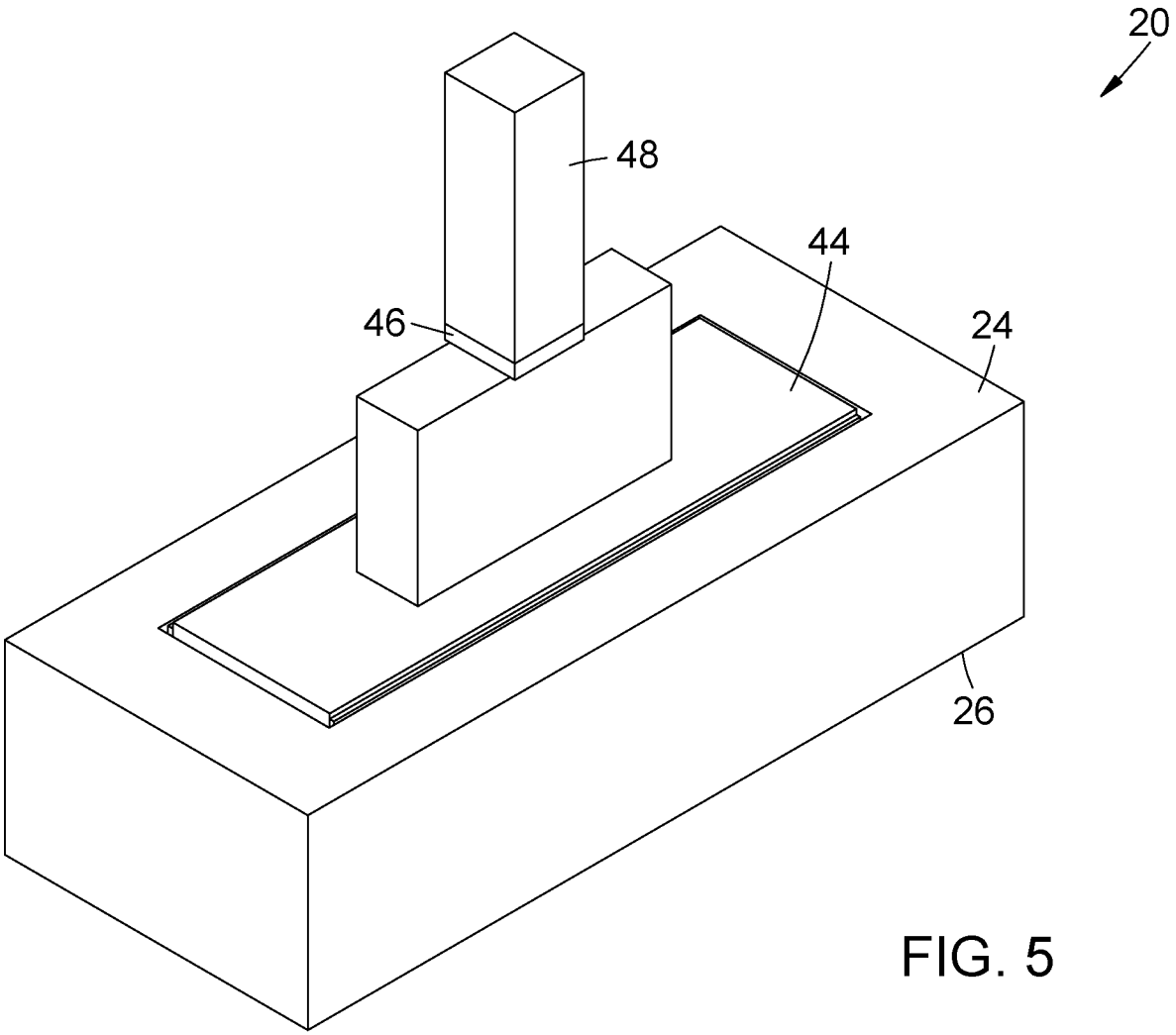
FIG. 5 is a schematic top perspective view of the anode assembly shown in FIG. 1.

Referring now to FIGS. 2 to 4, in the embodiment shown, the anode assembly 20 further includes a rod 48 and an electrically conductive clad 46. The rod 48 is connectable to an electrical current source (not shown) and joined to the crossbar 44 by the electrically conductive clad 46. Thus, the electric current can flow from the electrical current source to the baked anode block 22 sequentially through the rod 48, the electrically conductive clad 46, the crossbar 44, the electromechanical crossbar connector 40, and the elongated connection elements 28.

Still referring to FIGS. 2 to 4, in the embodiment shown, the bottom faces 36 of the elongated connection elements 28 are positioned at a height comprised between 5% and 40% of the height of the baked anode block 22 when measured from an uppermost section of the top surface 24 of the baked anode block 22. In another embodiment, the bottom faces 36 of the elongated connection elements 28 may be positioned at a height comprised between 15% and 30% of the height of the baked anode block 22, still when measured from an uppermost section of the top surface 24 of the baked anode block 22.

Still referring to FIGS. 2 to 4, in the illustrated embodiment, it can be appreciated that the elongated connection elements 28 extend substantially parallel to the longitudinal faces of the baked anode block 22, i.e. along the longest dimension of the baked anode block 22. As mentioned above, the anode block contact surfaces 30 of the elongated connection elements 28 distribute the electrical current to the baked anode block 22. Thus, if the elongated connection elements 28 get longer and therefore have more surface area, i.e. larger anode block contact surfaces 30, electrical current can be more evenly distributed in the baked anode block 22. Moreover, larger anode block contact surfaces 30 and a more even electrical current distribution may lead to a lower electrical resistance from the elongated connection elements 28 to the base 26 of the baked anode block 22. In some implementations, a ratio of a width of the elongated connection elements 28 versus the length of the elongated connection elements 28 may range from 0.1 to 5 and, in other implementations, between 0.15 and 3.5. In other implementations, a ratio of the height of the elongated connection elements 28 versus the length of the elongated connection elements 28 may range from 2 to 20.

In the embodiment described above, the anode assembly 20 comprises an array of embedded elongated connection elements 28 joined together by the crossbar 44. The embedded elongated connection elements 28 extend in a parallel fashion and are positioned in a spaced arrangement in the baked anode block 22. In some implementations (not illustrated), the width of the array is limited by the oxidation reaction occurring in the baked anode block 22 during operation of the electrolysis cell. The length of the embedded elongated connection elements 28 forming the array is also limited by the oxidation reaction occurring in the baked anode block 22 during operation of the electrolysis cell. The array of elongated connection elements 28 can advantageously distribute electrical current more evenly in an upper portion of the anode block 22, thereby promoting a more even distribution of the electrical current in a lower portion of the anode block 22. This more even distribution of the electrical current in the upper portion of the anode block 22 allows the current to travel along a vertical path directly from the elongated connection elements 28 to the base 26 of the anode block 22. Advantageously, an electric current travelling along a shorter path leads to a reduced electrical resistance.

Figure 6:
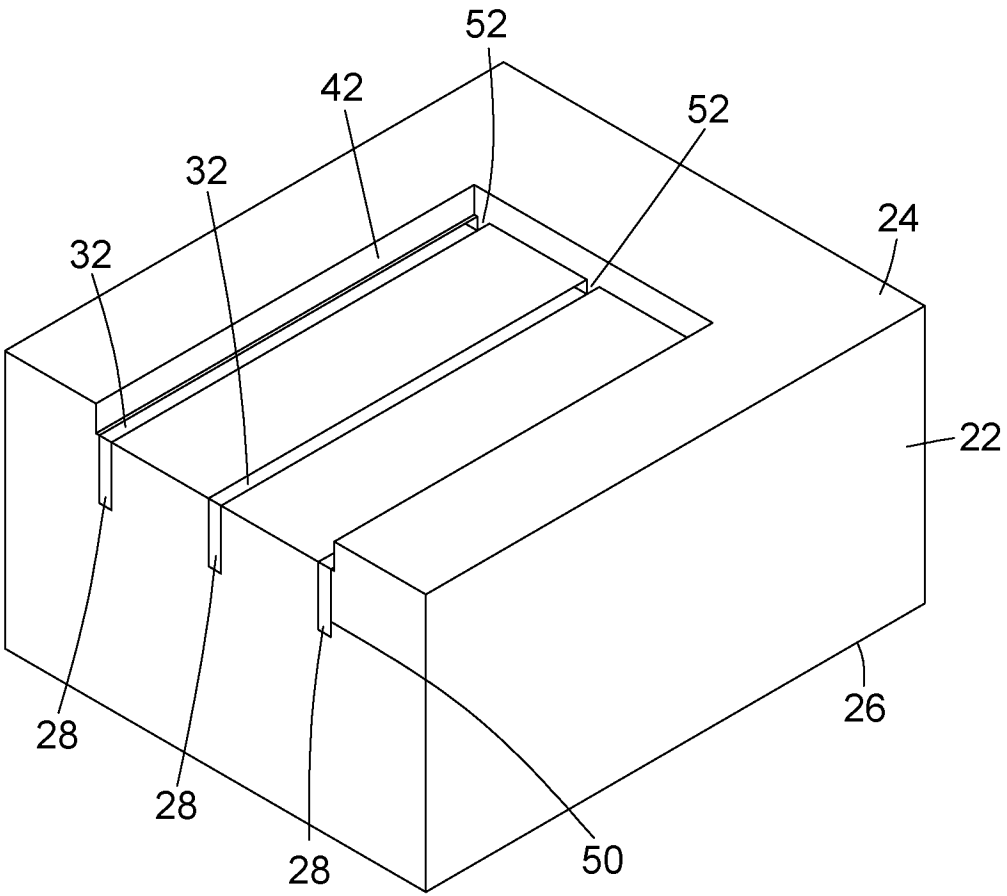
FIG. 6 is a schematic perspective cross-section view of the anode assembly shown in FIG. 1, with a crossbar and an electromechanical crossbar connector omitted.
Figure 7:
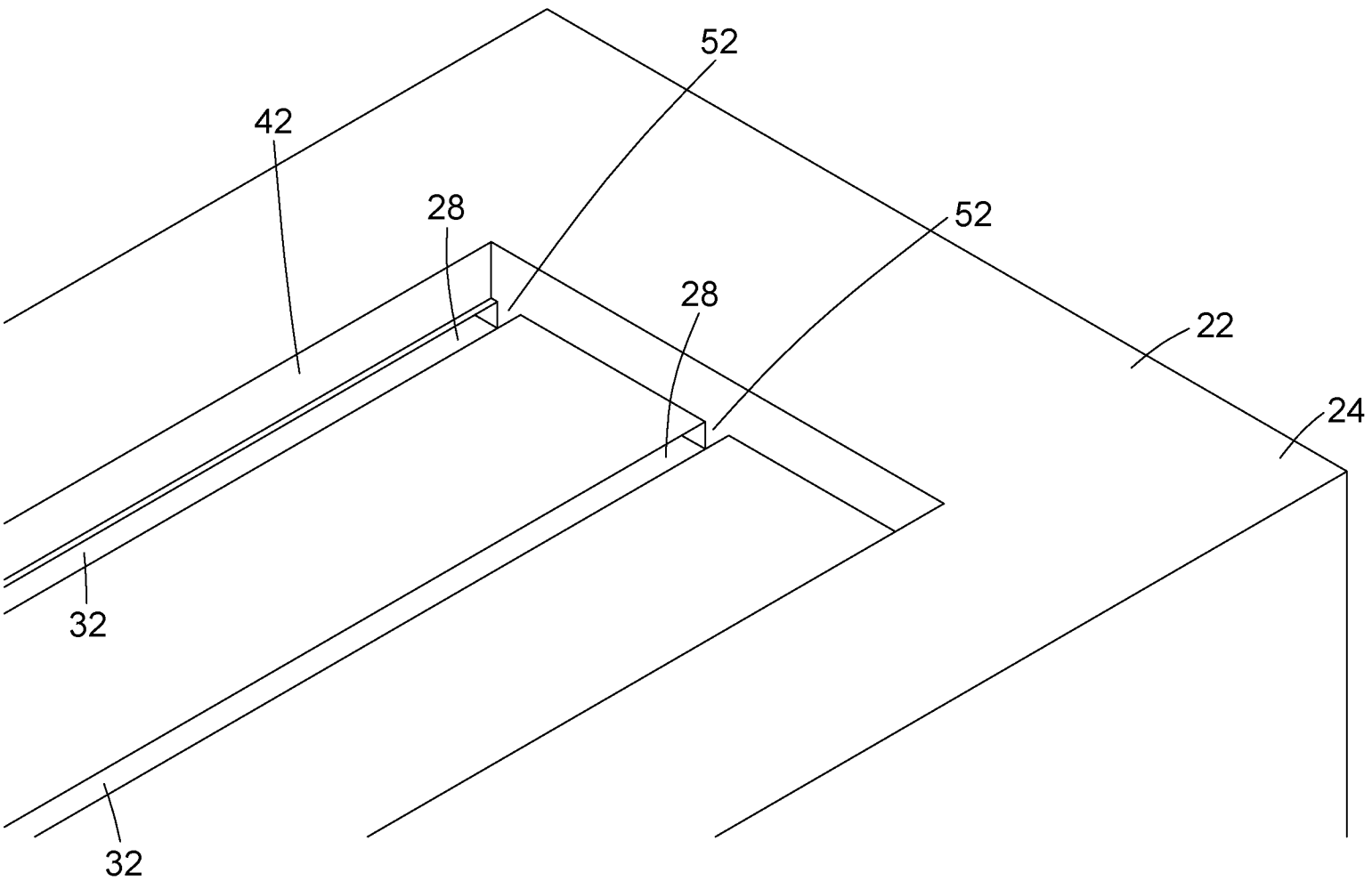
FIG. 7 is an enlarged schematic partial perspective view of the anode assembly shown in FIG. 6.
Figure 8:
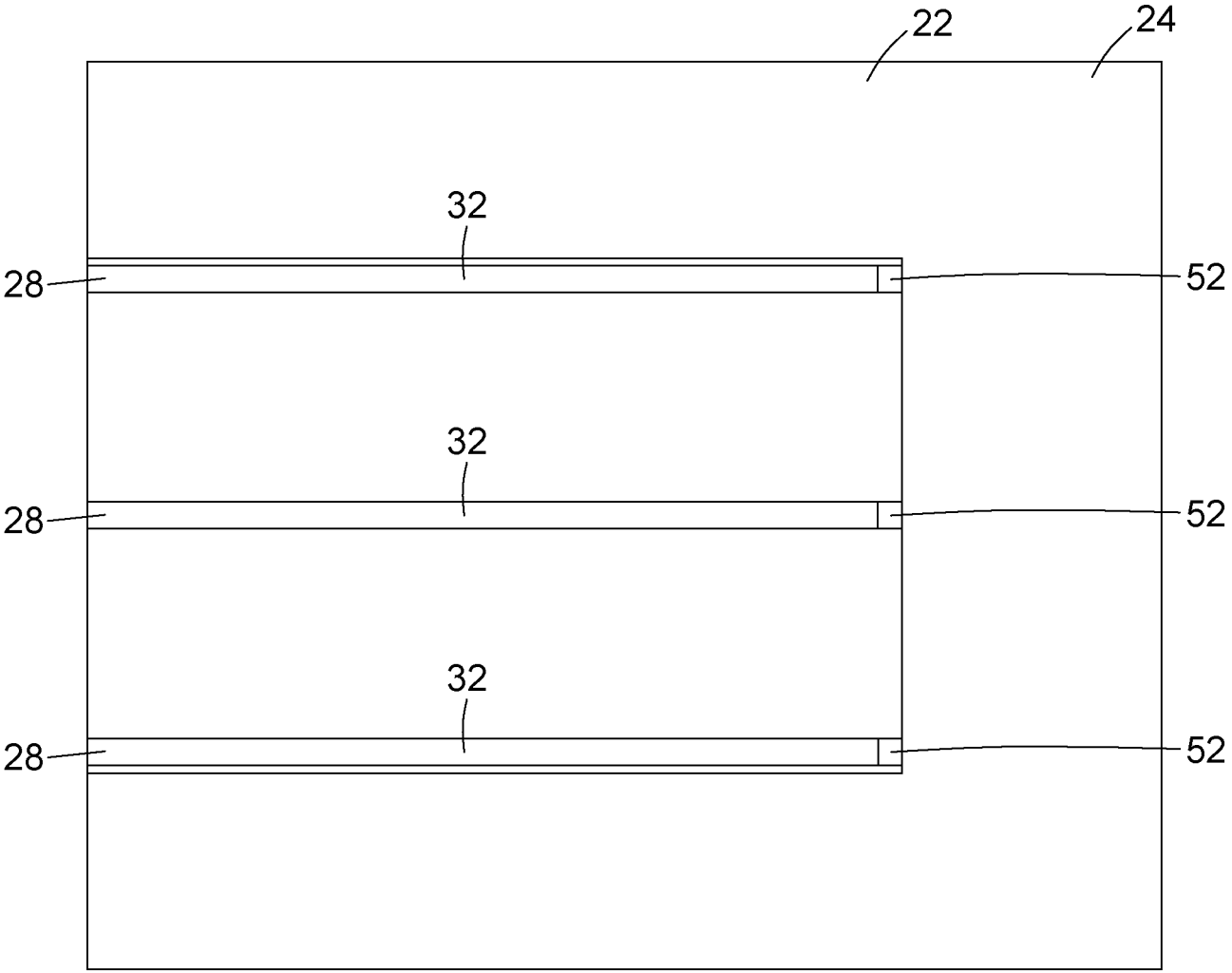
FIG. 8 is a schematic top view of the anode assembly shown in FIG. 6.

Now referring to FIGS. 6 to 8, in the illustrated embodiment, the baked anode block 22 includes a plurality of elongated slots 50, extending substantially parallel to one another and spaced-apart from one another. In the embodiment shown, the elongated slots 50 are opened in the connector molding cavity 42, i.e. the elongated slots 50 extend downwardly in the baked anode block 22 from the connector molding cavity 42. In the embodiment shown, the elongated slots 50 have substantially the same width, depth, and height. Each one of the elongated connection elements 28 is located into a respective one of the elongated slots 50, prior to baking, in order to be contained therein. Following insertion, the anode block contact surfaces 30 of the elongated connection elements 28 are substantially aligned with one another, in a same plane. In an embodiment, the elongated slots 50 are obtained by insertion of the elongated connection elements 28 in the green anode paste. In another embodiment, the elongated slots 50 can be formed prior to the insertion of the elongated connection elements 28 in the green anode block.

Each one of the elongated slot 50 can be shaped and sized to receive a respective one of the elongated connection elements 28, being of a complementary shape and size thereof. Moreover, in the embodiment shown, the elongated slots 50 extend substantially normal to the top surface 24 of the baked anode block 22. Thus, the elongated connection elements 28 are contained in the baked anode block 22 with the anode block contact surfaces 30 being embedded therein with a normal orientation relative to the top surface 24 of the baked anode block 22. Therefore, a top face of each of the elongated connection elements 28 is substantially parallel to the top surface 24 of the baked anode block 22.

In an embodiment (not illustrated), the elongated slots 50 can include a liner of graphite-based material, juxtaposed to a surface of the baked anode block 22 in the elongated slots 50. In another embodiment (not illustrated), the elongated connection elements 28 can be coated with a graphite-based material before being inserted in the baked anode block 22. Even though the elongated slots 50 can include a liner of graphite-based material, for the description, the anode block connection surface 30 is considered to be conterminous with the material of the anode block.

In the embodiment shown in FIGS. 6 to 8, the elongated slots 50 also have a length exceeding a longitudinal face length of the elongated connection elements 28 insertable therein, therefore forming an extra spacing 52 at each end thereof. The extra spacing 52 in the elongated slots 50 can allow the embedded elongated connection elements 28 to substantially freely expand in the direction of the extra spacing 52 during operation of the electrolysis cell. Indeed, thermal expansion of the embedded elongated connection elements 28 can create significant stress to the surrounding baked anode block 22, which may lead to the formation of cracks in the baked anode block 22. In this embodiment, the lateral end faces 38 of the elongated connection elements 28 can contact the baked anode block 22 if the extra spacing is shorter than the inherent longitudinal thermal expansion of the elongated connection elements 28 during operation.

Figure 9:
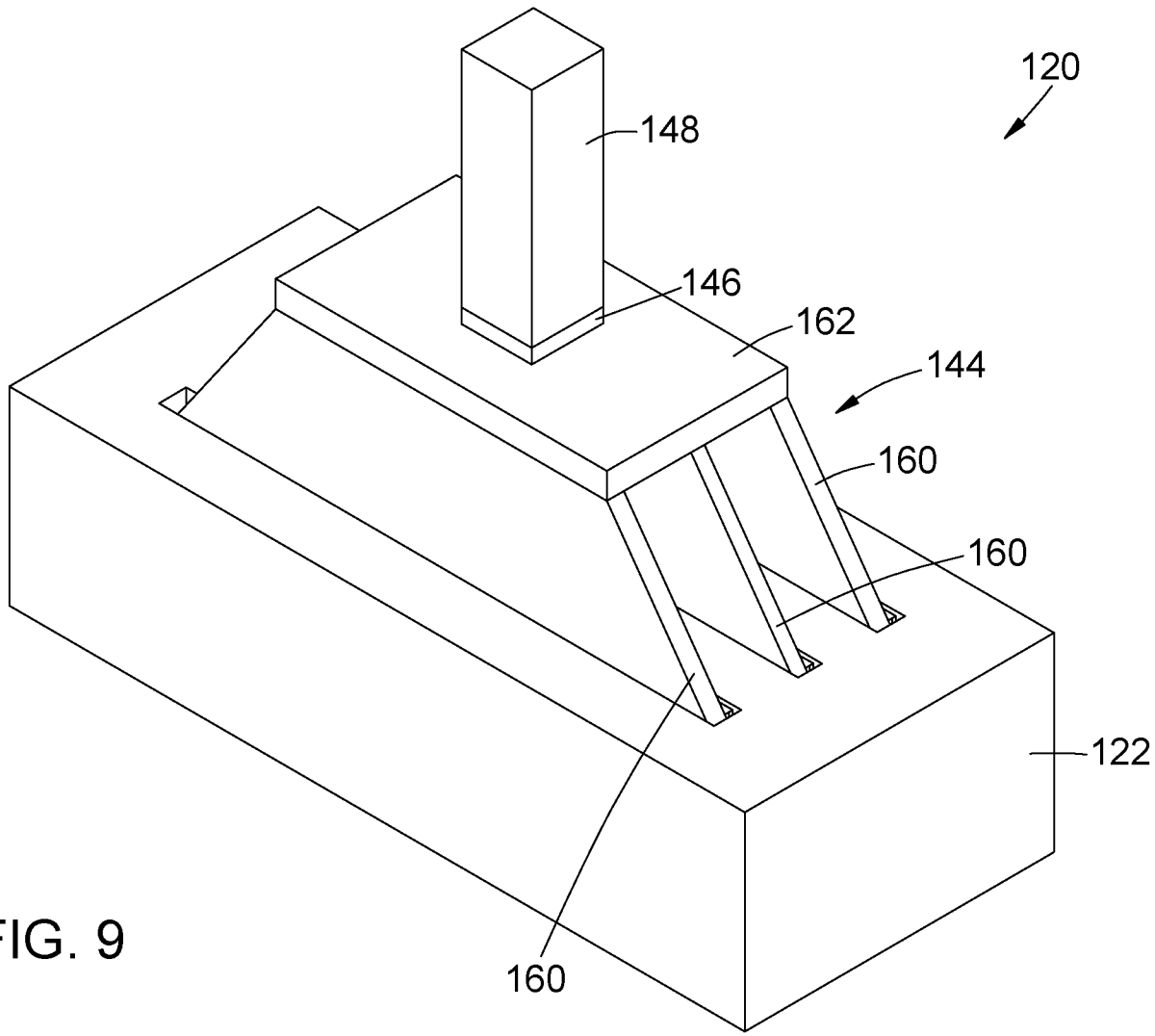
FIG. 9 is a schematic perspective view of an anode assembly in accordance with a second embodiment with a plurality of electromechanical crossbar connectors.
Figure 10:
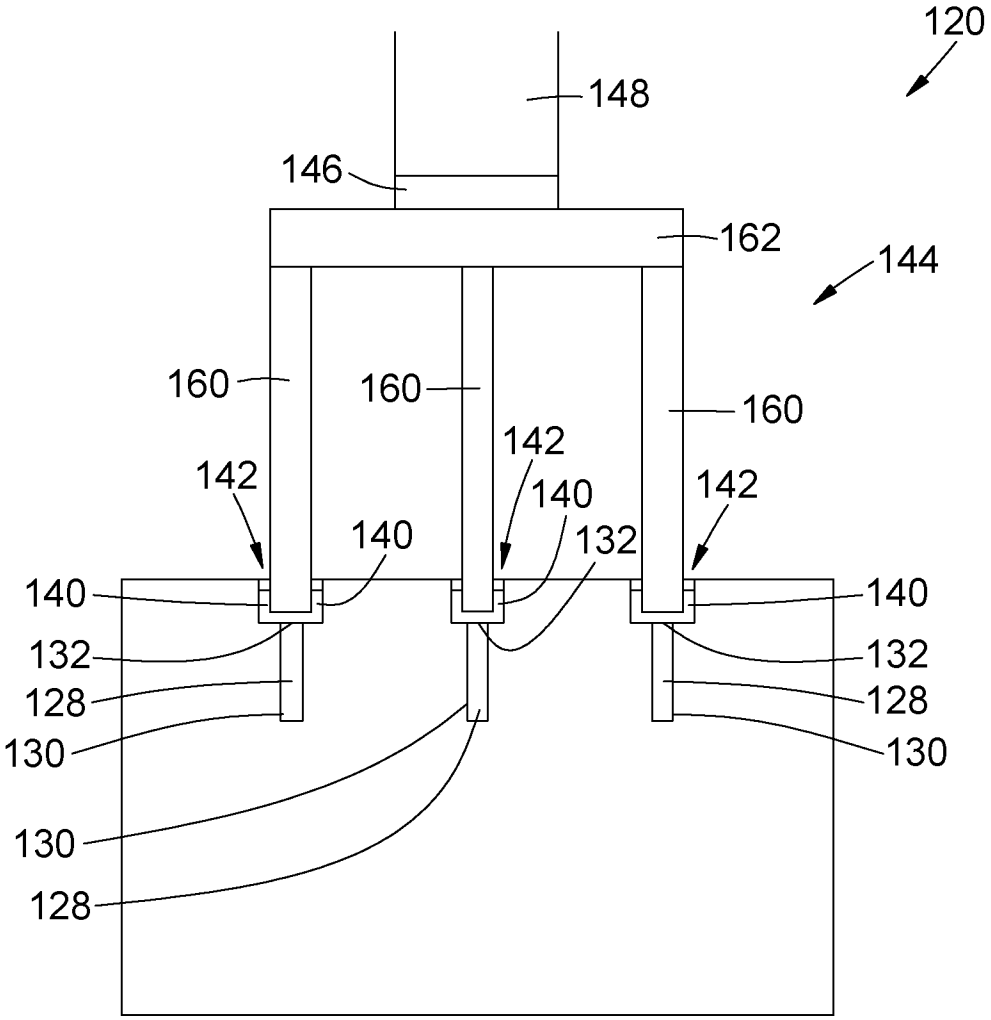
FIG. 10 is a schematic cross-section view of the anode assembly shown in FIG. 9.

Referring to FIGS. 9 and 10, there is shown a second embodiment of the anode assembly 120 wherein the features are numbered with reference numerals in the 100 series which correspond to the reference numerals of the first embodiment with the following adaptations.

Referring now to FIGS. 9 and 10, in the second embodiment of the anode assembly 120, the baked anode block 122 still includes a plurality of elongated connection elements 128 contained therein. However, instead of having a single central connector molding cavity 42, the baked anode block 122 comprises a plurality of connector molding cavities 142, extending substantially parallel to another and spaced-apart from one another. As the above-described embodiment, each elongated connection element 128 includes an anode block connection surface 130 and an electrical connection surface 132. Moreover, the elongated connection elements 128 are substantially aligned with one another and have substantially the same depth. Prior to insertion of the electromechanical crossbar connector 140, the electrical connection surface 132 of each elongated connection element 128 is exposed in a respective one of the connector molding cavities 142. Following insertion of the electromechanical crossbar connector 140, the electrical connection surface 132 of each elongated connection element 128 is thus covered by an electromechanical crossbar connector 140. In the second embodiment, each one of the electromechanical crossbar connectors 140 is contained in one of the connector molding cavities 142, i.e. each elongated connection element 128 is associated to a connector molding cavity 142 substantially defined above their respective electrical connection surface 132. Positioned above the baked anode block 122, there is provided a crossbar 144 including a horizontal plate 162 and a plurality of trapezoidally-shaped downwardly extending plates 160. Each one of the downwardly protruding plates is electrically connecting the horizontal plate 162 of the crossbar 144 to each one of the electromechanical crossbar connectors 140. As in the first embodiment, the crossbar 144 is electrically connected to a rod 148 through an electrically conductive clad 146 thus defining an electrical path between an electric current source and the baked anode block.

Figure 12:
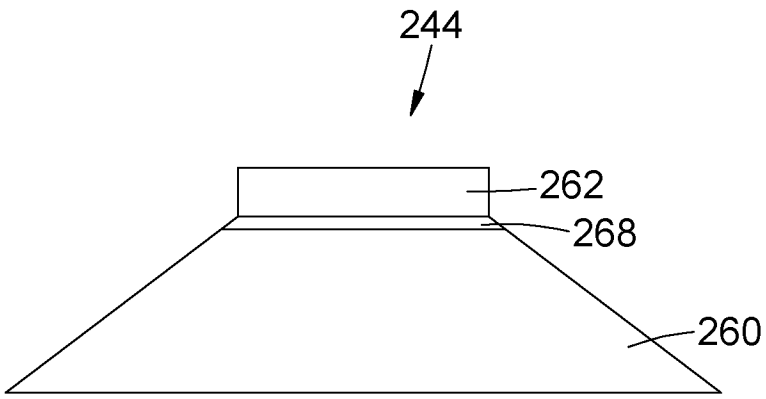
FIG. 12 is a schematic front elevation cross-section view of the crossbar shown in FIG. 11.
Figure 11:
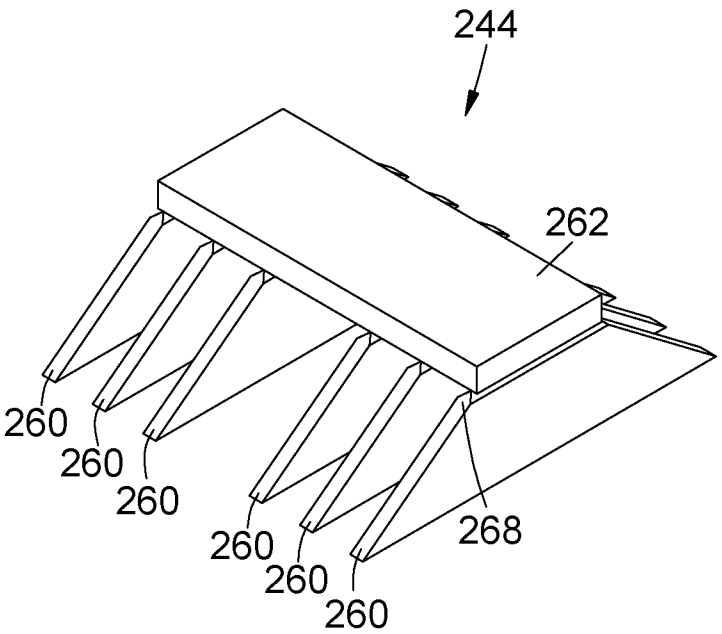
FIG. 11 is a schematic perspective view of a crossbar of two anode assemblies in accordance to a third embodiment, wherein a horizontal section and a plurality of downwardly extending plates of the crossbar are shown before welding.

Referring to FIGS. 11 and 12, there is shown a crossbar designed for two anode assemblies, in accordance with a third embodiment. The features of this embodiment are numbered with reference numerals in the 200 series, which correspond to the reference numerals of the first and second embodiments with the following adaptations.

More particularly, the crossbar 244 is designed for use with two baked anode blocks (not shown). The crossbar 244 includes a single horizontal plate 262 connecting together two sets of spaced-apart trapezoidally-shaped and downwardly extending plates 260. A first one of the sets is designed to mechanically and electrically connect with a first anode block (not shown), while a second one of the sets is designed to mechanically and electrically connect with a second anode block (not shown). Each one of the sets includes three spaced-apart downwardly extending plates 260. It is appreciated that a distance between adjacent ones of the plates 260 of the first and second sets are farther apart than adjacent plates 260 in one of the sets.

In the embodiment shown, the downwardly extending plates 260 are shown before their welding to the crossbar 262. The upper edge 268 of the downwardly extending plates 260 has a triangular shape, which may facilitate their welding to the crossbar 262.

Figure 13:
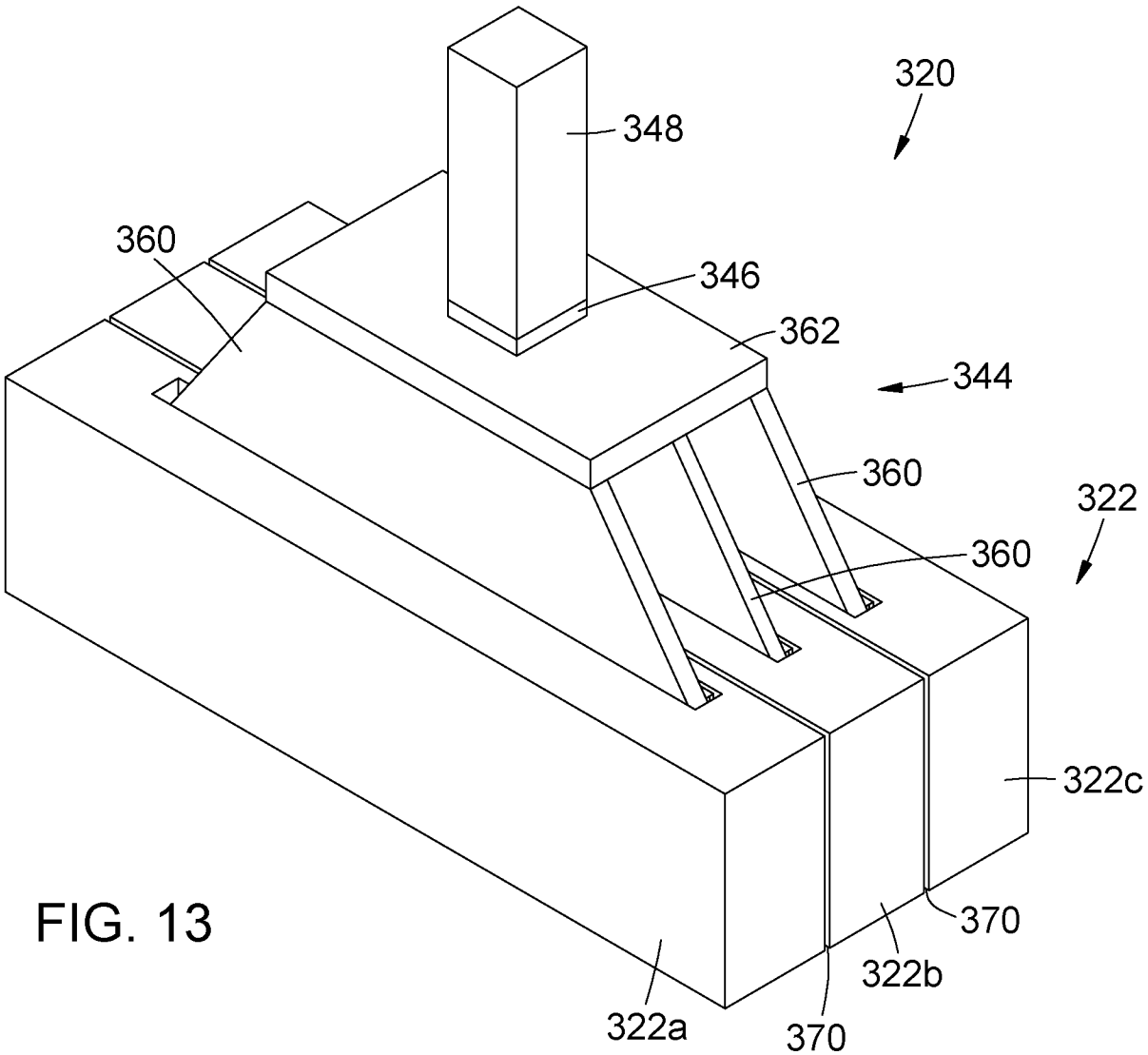
FIG. 13 is a schematic perspective view of an anode assembly in accordance with a fourth embodiment wherein the anode block includes a plurality of anode block sections separated by a gap.
Figure 14:
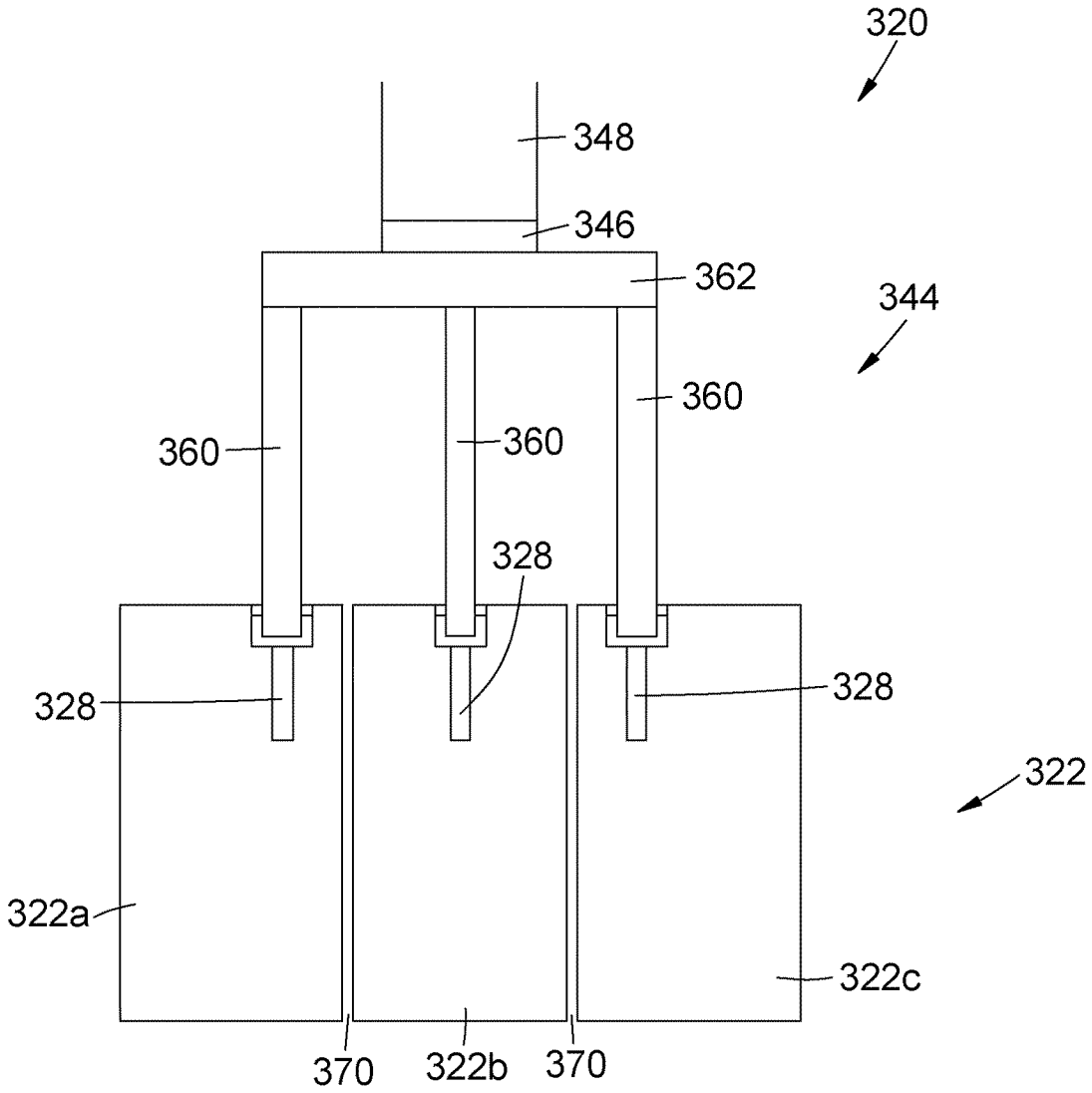
FIG. 14 is a schematic cross-section view of the anode assembly shown in FIG. 13.

Referring to FIGS. 13 and 14, there is shown a fourth embodiment of the anode assembly 320 wherein the features are numbered with reference numerals in the 300 series which correspond to the reference numerals of the first embodiment with the following adaptations.

In the fourth embodiment, the baked anode block 322 includes a plurality of anode block sections 322*a*, 322*b*, 322*c* separated by a gap 370. Each one of the anode block sections 322*a*, 322*b*, 322*c* includes an elongated connection element 328 contained therein, as described above in reference to the second embodiment. Thus, the electric current can flow from an electrical current source to each one the anode block sections 322*a*, 322*b*, 322*c*. In this embodiment, the gap 370 defined between each one of the anode block sections 322*a*, 322*b*, 322*c* can allow the free thermal expansion of the horizontal section 362 of the crossbar 344 during operation of the anode assembly 320. The gap 370 can have a width ranging from 5 to 20 mm. The crossbar 344 of this third embodiment is similar to the one described in the second embodiment with spaced-apart trapezoidally-shaped and downwardly extending plates 360 connected to one another through the horizontal plate 362. As detailed above, the crossbar 344 is electrically connected to a rod 348 through an electrically conductive clad 346 thus defining an electrical path between an electric current source (not shown) and the baked anode block 322.

Figure 15:
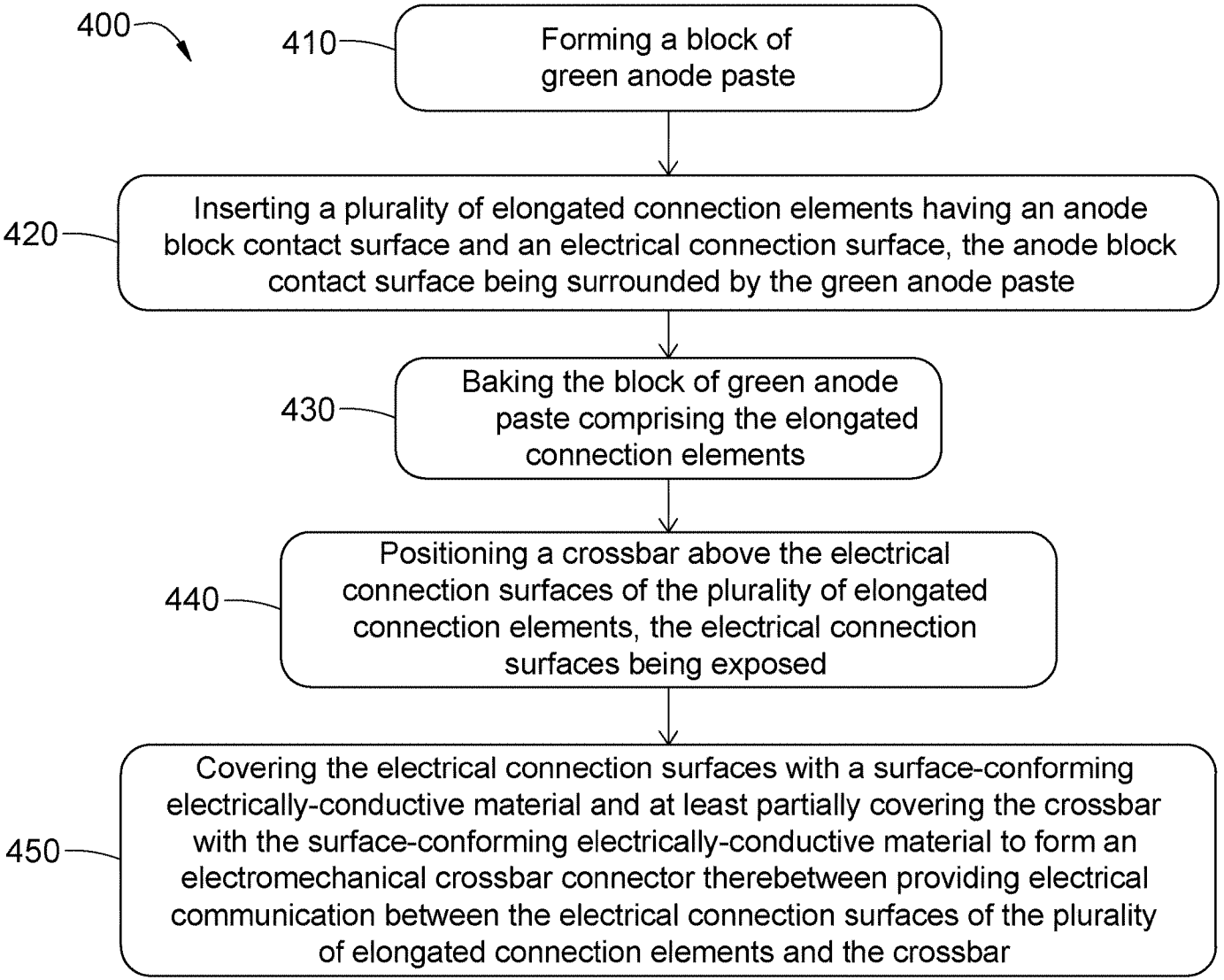
FIG. 15 is a flowchart for a method for manufacturing an anode assembly for aluminum electrolysis cells, in accordance with an embodiment.

In accordance with a second aspect and with continuing reference to FIG. 15, there is provided a method 400 for manufacturing anode assemblies for aluminum electrolysis cells. The method 400 includes the following steps.

A block of green anode paste is formed 410. Optionally, one or several recesses, which will substantially correspond to the connector molding cavity(ies) of the baked anode block, are defined in the top surface of the green anode paste, simultaneously during the forming of the block of green anode paste. It is appreciated that they can be defined at a later stage, either simultaneously during insertion or following insertion of the elongated connection elements. Optionally, a plurality of elongated slots is defined in the block of green anode paste, in the connector molding cavity, if any.

In an embodiment, the elongated slots and the recess(es) corresponding to the connector molding cavity(ies), are formed simultaneously with the insertion 420 of the elongated connection elements in the block of green anode paste. In a non-limitative embodiment, a hydraulic punch can be used to insert the elongated connection elements in the green anode paste. The shape and configuration of the hydraulic punch can be conceived to simultaneously form the elongated slots, and/or the recess(es) corresponding to the connector molding cavity(ies), in the block of green anode paste. The elongated connection elements are inserted in the green anode paste in a manner such that the anode block contact surface 30 is surrounded by the green anode paste. In an embodiment, the elongated connection elements are inserted in the green anode paste in a manner such that the electrical connection surface is exposed at the top surface of the block of green anode paste. In an embodiment, the insertion of the elongated connection elements in the green anode paste is done during compaction, which may improve the contact between the anode block contact surfaces of the elongated connection elements with the block of green anode paste. Optionally, the elongated connection elements 28 may be pre-heated before being inserted into the green anode paste, which may contribute to a better compaction in the vicinity of the elongated connection elements 28. For instance and without being limitative, the pre-heating temperature can range from 50° C. to 300° C. If the green anode includes recess(es) corresponding to the connector molding cavity(ies), the electrical connection surface of the elongated connection elements can be exposed in the connector molding cavity. Optionally, each one of the plurality of elongated connection elements is respectively inserted in one of a plurality of elongated slots defined in the green anode paste.

Then, the block of green anode paste comprising the elongated connection elements is baked 430 into a baked anode block, as it is known in the art.

If the electrical connection surfaces of the plurality of elongated connection elements are not exposed following baking, the electrical connection surfaces are first exposed.

Then, the crossbar is positioned 440 above the electrical connection surfaces of the plurality of elongated connection elements and the connector molding cavity, if any. For instance, a lower section of the crossbar can be positioned in the connector molding cavity(ies), if any. The electrical connection surfaces of the elongated connection elements and the lower section of the crossbar are then covered 450 with a surface-conforming electrically-conductive material to form the electromechanical crossbar connector. If the baked anode block includes one or more connector molding cavities, the connector molding cavity(ies) can be at least partially filled with the surface-conforming electrically-conductive material.

In such an embodiment, the covering of the electrical connection surfaces of the elongated connection elements can include pouring molten cast iron into the connector molding cavity(ies). If the elongated slots of the baked anode block are longer than the elongated connection elements, the empty portions of the elongated slots, i.e. the extra spacing, may also be filled with the surface-conforming electrically-conductive material to increase the mechanical connection between the crossbar and the baked anode block. Then, a section of the crossbar is covered by the surface-conforming electrically-conductive material before it sets into the electromechanical crossbar connector. For instance, the crossbar can be partially covered by the molten cast iron as it is poured over the electrical connection surfaces of the elongated connection elements. The crossbar is covered by the electromechanical crossbar connector to a given depth. This depth defines the thickness of the electromechanical crossbar connector, i.e. the dimension of the electromechanical crossbar connector between the above-positioned crossbar and the underlying embedded elongated connection elements. This thickness can be up to 25% of the height of the baked anode block. In another embodiment, the thickness can be up to 15% of the height of the baked anode block. In an embodiment, a lower face of the crossbar is spaced-apart from the electrical connection surfaces of the elongated connection elements when adding/pouring the surface-conforming electrically-conductive material in a manner such that the electromechanical crossbar connector extends therebetween in the anode assembly. When set, the electrically-conductive material forms the electromechanical crossbar connector providing electrical communication between the electrical connection surfaces of the plurality of elongated connection elements and the crossbar.

It will be appreciated that the method described herein may be performed in the described order, or in any suitable order.

The above-described method provides an apparatus that can be advantageously serviceable at the end of the life cycle of the anode assembly, i.e. when the anode is partially consumed. For example, the elongated connection elements can be extracted from the baked anode block at the end of an anode cycle and reinserted in a newly formed green anode paste prior to baking. Thus, the refurbished elongated connection elements insertable in a newly formed block of anode paste prior to baking thus lowers the maintenance costs of anode assemblies. The elongated connection elements can be reused as long as their dimensions are within a prescribed range. In the embodiment described above, the elongated connection elements are substantially rectangular plates.

The above-described configuration and method allow providing elongated connection elements for an anode assembly for an aluminum electrolysis cell having a chemical composition and dimensions for a predicted thermal expansion inside a green anode paste during baking of the green anode paste into the anode block.

In order to achieve a low electrical resistance, a factor to take into account is the chemical composition of the material of the elongated connection elements. In an embodiment wherein the elongated connection elements are made of steel, an option is to vary the carbon percentage of the steel.

Another factor to consider is the geometry of the elongated connection elements. The geometry of the elongated connection elements and of the extra spacing, if any, can be selected so as to allow thermal expansion in at least one or some directions (longitudinally, laterally, and/or vertically). As mentioned earlier, the extra spacing provided close to the elongated connection elements can allow the elongated connection elements to freely expand in the direction of the extra spacing. For example, in the embodiment shown in FIG. 5, the extra spacing allows for the elongated connection elements to freely expand along its longitudinal axis during the baking of the anode paste into an anode block. The baking of the green anode paste occurs at temperatures ranging from ambient temperature up to 1200° C.

As mentioned above, the surface area of the lateral end of the elongated connection elements is significantly smaller than the surface area of the vertically-extending longitudinal faces. Thus, the lateral end contribute to a small proportion of the electrical current that can be conducted from each of the elongated connection elements to the baked anode block compared to the longitudinal faces of the elongated connection elements. Consequently, providing the extra spacing adjacent to the lateral ends of the elongated connection elements allow thermal expansion without significantly reducing electrical conduction with the baked anode block.

In an embodiment wherein the elongated slots have a length substantially equal to a longitudinal face length of the elongated connection elements, an extra spacing between the elongated connection element and the anode block contact surfaces may be formed when the anode block is cooled to ambient temperature after baking, due to complex phenomenon occurring during baking process. This extra spacing may also prevent damages in the baked anode block. Indeed, damages, such as cracks, can be caused by the stress induced by the expanding elongated connection elements contained in the baked anode block during electrolysis.

Moreover, the above-described configuration and method allow providing a plurality of elongated connection elements for an anode assembly for aluminum electrolysis cells having a chemical composition and dimensions providing a predicted thermal expansion inside a baked anode block during operation of the electrolysis cell.

The operation temperature in the vicinity of the elongated connection elements may be between 400° C. and 1000° C. In an embodiment, the operation temperature may be 550° C. and 950°. As mentioned above, the chemical composition of the material of the elongated connection elements is a known factor and the resulting thermal expansion behavior can be well documented. The other factor to take into account is therefore the dimensions of the elongated connection elements contained in the baked anode block.

The promotion of a contact pressure between the anode block contact surface of the elongated connection element and the baked anode block can be important in order for the electric current to pass from the elongated connection element to the baked anode block. For instance and without being limitative, a sufficient contact pressure leading to a low electrical resistance on the entire anode block contact surface can be obtained at 400° C. and be maintained up to 1000° C. In an embodiment, the sufficient contact pressure can be obtained at 550° C. and be maintained up to 1000° C., wherein the contact pressure has increased because of the thermal expansion of the elongated connection element. However, the thermal expansion of the elongated connection element can also be set in order to prevent damages in the baked anode block. Indeed, damages, such as cracks, can be caused by the stress induced by the expanding elongated connection elements contained in the anode block.

Since the chemical composition and the dimensions of the elongated connection elements can be selected to predict the thermal expansion of the elongated connection elements at a temperature above 400° C. and more particularly, above 550° C., the following example illustrates the impact of one variable of the elongated connection elements on the efficiency of one elongated connection element to transmit electric current from the electrical connection surface to the baked anode block.

Example 1: Thickness Evaluation of Elongated Connection Elements in Baked Anode Assemblies In the following example, an embodiment of an elongated connection element 28 for an anode assembly for an aluminum electrolysis cell having a chemical composition and dimensions for a predicted thermal expansion inside a baked anode block during operation of the electrolysis cell was tested by isolating one variable: the thickness of the elongated connection element. The thickness of the elongated connection element can be a factor contributing to the regulation of the contact pressure caused by thermal expansion between the electrical connection surface of the connection element and the baked anode block.

Again, there is a need to promote the contact pressure since the contact pressure promotes the flow of the electric current from the elongated connection element to the baked anode block. On the other hand, if the contact pressure is too high, the contact pressure can cause damages to the baked anode block, such as cracks, thereby increasing the electrical resistance of the baked anode block. Thus, there is a balance to reach between a contact pressure allowing an electric current to pass from the elongated connection element to the baked anode block, and a contact pressure that does not cause damages to the anode block during operation of the electrolysis cell.

The thickness of the elongated connection element can be selected by notably taking into account the Joule effect resulting from the current passing in the electromechanical crossbar connector between the crossbar and the elongated connection element through the electrical connection surface thereof. If the thickness of the elongated connection element is small, the electrical connection surface of the elongated connection element is also small and the electric current has less surface area to get into the elongated connection element. Thus, a small electrical connection surface can lead to an undesirable increase in electrical resistance between the crossbar and the elongated connection element 28. If the thickness of the elongated connection element is large, other problems such as the ones mentioned above related to cracking problems generated in the baked anode block can appear. Again, a balance should be reached.

For the present example, it is to be understood that the baked anode block was manufactured in accordance with the above described method 400 in order to improve the contact by minimizing a gap formed between the anode block contact surface of the elongated connection element and the baked anode block.

Figure 16:
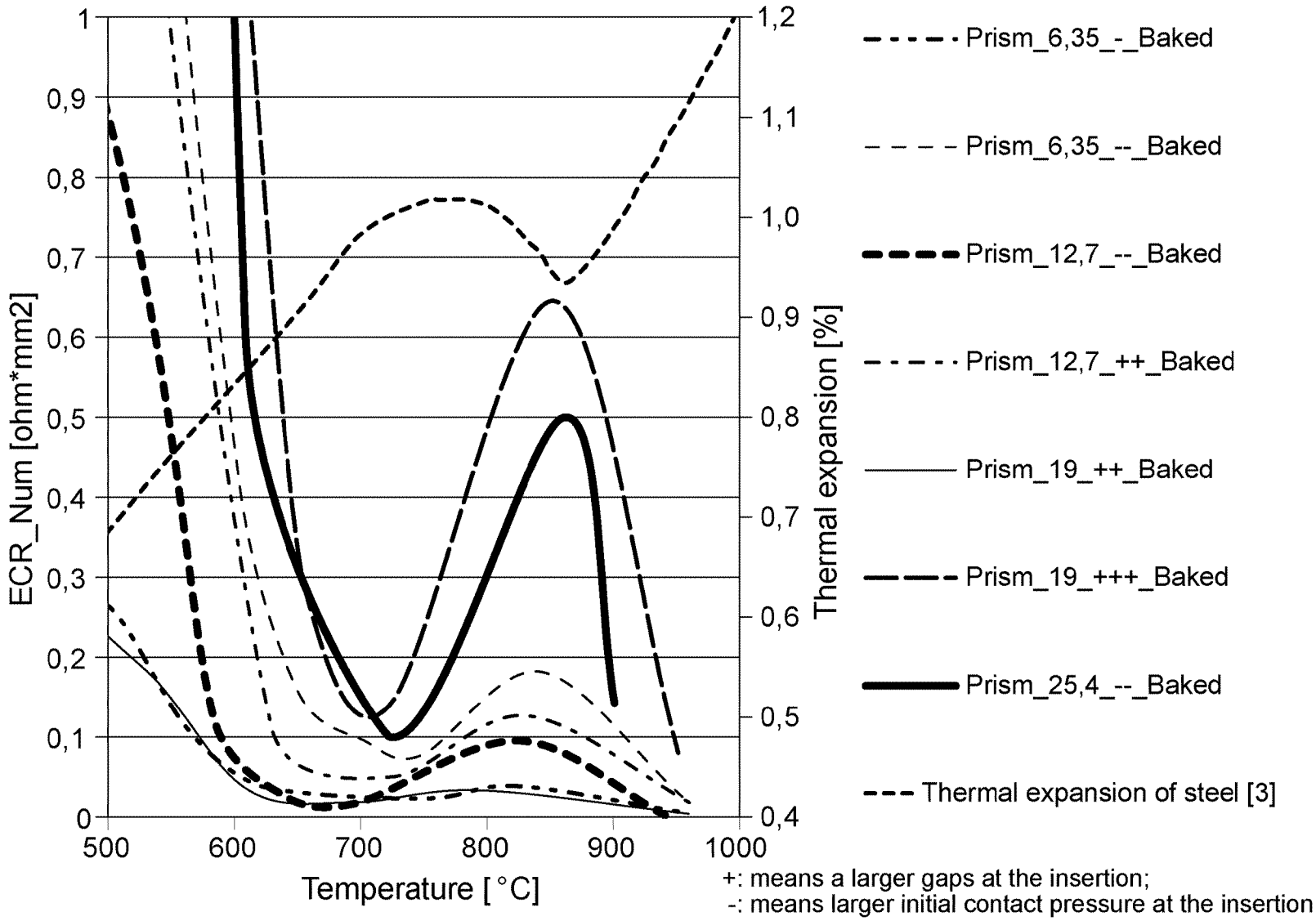
FIG. 16 is a graph showing a relation between specific electrical resistance and thermal expansion of steel as a function of temperature for various embodiments of the anode assembly described herein.

Referring now to FIG. 16, there is shown the effect of the thickness of the elongated connection element on the electrical contact resistance when electric current passes from the elongated connection element to the baked anode block. The results suggest that a relatively thin elongated connection element can be beneficial since the electrical contact resistance (ECR) from the elongated connection element to the baked anode block was low at the beginning of the operational temperature, which corresponds approximately to between 400° C. to 650° C. and the predicted thermal expansion appearing at operational temperatures kept the electrical contact resistance low between the elongated connection element and the baked anode block.

As shown on FIG. 16, better performances were achieved over the operation temperature range for elongated connection elements having a thickness of 6.35 mm (Prism_6,35_) and 12.7 mm (Prism_12,7_).

Therefore, in an embodiment of the above-described anode assembly, the contact pressure between the anode block contact surface of the elongated connection element and the baked anode block during operation of the electrolysis cell can be substantially even throughout a portion of the anode block contact surface of the elongated connection element. In another embodiment, the thickness of the elongated connection element can be comprised between about 2 mm and about 50 mm. In yet another embodiment, the thickness of the elongated connection element 28 can be comprised between about 6 mm and about 19 mm.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. An anode assembly for an aluminum electrolysis cell, the anode assembly comprising:

a baked anode block comprising at least one connector molding cavity;

a plurality of elongated connection elements extending longitudinally along at least 50% of a length of the baked anode block, each having an anode block contact surface and an electrical connection surface, the anode block contact surface being embedded in the baked anode block and being in electrical communication with the baked anode block;

at least one electromechanical crossbar connector covering the electrical connection surfaces of the plurality of elongated connection elements and extending in and at least partially filling the at least one connector molding cavity; and a crossbar having a lower section embedded in the at least one electromechanical crossbar connector and being in electrical communication therewith, the crossbar being electrically connected to the plurality of elongated connection elements through their electrical connection surfaces and the at least one electromechanical crossbar connector.

2. The anode assembly of claim 1, wherein the at least one connector molding cavity has a depth ranging between 2% to 25% of a height of the baked anode block.

3. The anode assembly according to claim 1, wherein the plurality of elongated connection elements extends parallel to one another and in a spaced-apart arrangement.

4. The anode assembly according to claim 1, wherein the anode block contact surface of the plurality of elongated connection elements is in direct contact with the baked anode block.

5. The anode assembly according to claim 1, wherein the baked anode block further comprises a plurality of elongated slots, and wherein each one of the plurality of elongated connection elements is inserted into a respective one of the plurality of elongated slots.

6. The anode assembly according to claim 1, wherein each one of the plurality of elongated connection elements has a thickness ranging from 2 to 50 mm.

7. The anode assembly according to claim 1, wherein a length of each one of the plurality of elongated connection elements is comprised between 50% and 80% of a length of the baked anode block.

8. The anode assembly according to claim 1, wherein the plurality of elongated connection elements are positioned at a height comprised between 5% and 40% of a height of the baked anode block, below an uppermost surface thereof.

9. The anode assembly according to claim 1, wherein the plurality of elongated connection elements extends parallel to longitudinal faces of the baked anode block.

10. The anode assembly according to claim 1, wherein at least one of the plurality of elongated connection elements has at least one surface coated with a graphite-based material.

11. The anode assembly according to claim 1, wherein the baked anode block comprises a plurality of anode block sections separated by a gap.

12. An aluminum electrolysis cell comprising the anode assembly according to claim 1.

13. An anode assembly for an aluminum electrolysis cell; the anode assembly comprising:

a baked anode block;

a plurality of elongated connection elements extending longitudinally along at least 50% of a length of the baked anode block, each having an anode block contact surface and an electrical connection surface, the anode block contact surface being embedded in the baked anode block and being in electrical communication with the baked anode block;

at least one electromechanical crossbar connector covering entirely the electrical connection surfaces of the plurality of elongated connection elements; and a crossbar having a lower section embedded in the at least one electromechanical crossbar connector and being in electrical communication therewith, the crossbar being electrically connected to the plurality of elongated connection elements through their electrical connection surfaces and the at least one electromechanical crossbar connector.

14. The anode assembly according to claim 13, wherein the baked anode block comprises at least one connector molding cavity, the at least one electromechanical crossbar connector extending in and at least partially filling the at least one connector molding cavity.

15. The anode assembly according to claim 13, wherein the baked anode block further comprises a plurality of elongated slots extending parallel to one another in a spaced-apart arrangement; and wherein each one of the plurality of elongated connection elements is inserted into a respective one of the plurality of elongated slots.

16. The anode assembly according to claim 13, wherein the at least one electromechanical crossbar connector comprises a plurality of electromechanical crossbar connectors, each one of the plurality of electromechanical crossbar connectors being in electromechanical connection with a corresponding electrical connection surface of the plurality of elongated connection elements.

17. An anode assembly for an aluminum electrolysis cell, the anode assembly comprising:

a baked anode block;

a plurality of elongated connection elements extending longitudinally along at least 50% of a length of the baked anode block, each having an anode block contact surface and an electrical connection surface, the anode block contact surface being embedded in the baked anode block and being in electrical communication with the baked anode block;

an electromechanical crossbar connector covering the electrical connection surfaces of the plurality of elongated connection elements; and a crossbar having a lower section embedded in the at least one electromechanical crossbar connector and being in electrical communication therewith, the crossbar being electrically connected to the plurality of elongated connection elements through their electrical connection surfaces and the at least one electromechanical crossbar connector;

wherein the electromechanical crossbar connector comprises a section extending continuously between respective electrical connection surfaces of two adjacent ones of the plurality of elongated connection elements to establish electrical communication between the respective electrical connection surfaces.

18. A method for manufacturing an anode assembly for an aluminum electrolysis cell, the method comprising: manufacturing the anode assembly of claim 1 by, forming a block of green anode paste;

inserting the plurality of elongated connection elements having the anode block contact surface and the electrical connection surface in the block of green anode paste, the anode block contact surface being surrounded by the green anode paste;

baking the block of green anode paste comprising the elongated connection elements to obtain the baked anode block;

positioning the crossbar above the electrical connection surfaces of the plurality of elongated connection elements inserted in the baked anode block; and covering the electrical connection surface and at least partially the crossbar with a surface-conforming electrically-conductive material to form the at least one electromechanical crossbar connector therebetween providing electrical communication between the electrical connection surfaces of the plurality of elongated connection elements and the crossbar.

19. The method according to claim 18, further comprising forming the at least one connector molding cavity in the block of green anode paste, wherein the forming of the at least one connector molding cavity in the block of green anode paste comprises simultaneously inserting the plurality of elongated connection elements therein, the electrical connection surface of the elongated connection elements being exposed in the at least one connector molding cavity following insertion.

20. The method according to claim 18, wherein the inserting the elongated connection elements in the block of green anode paste comprises compacting the block of green anode paste and simultaneously inserting the elongated connection elements therein.

* * * * *